US007032250B1

(12) United States Patent
Davis et al.

(10) Patent No.: US 7,032,250 B1
(45) Date of Patent: Apr. 25, 2006

(54) WORKMAN'S VEST CONSTRUCTION

(76) Inventors: Abednego Ben Davis, 6850 Fresno St., Oakland, CA (US) 94605; Charles Quagala D'Johns, 6850 Fresno St., Oakland, CA (US) 94605

( * ) Notice: Subject to any disclaimer, the term of this patent is extended or adjusted under 35 U.S.C. 154(b) by 0 days.

(21) Appl. No.: 10/897,366

(22) Filed: Jul. 22, 2004

(51) Int. Cl.
*A41D 1/04* (2006.01)

(52) U.S. Cl. ..... 2/102

(58) Field of Classification Search ..... 2/102, 2/94, 2.5, 247–253, 69, 108, 920
See application file for complete search history.

(56) References Cited

U.S. PATENT DOCUMENTS 3,886,508 A * 5/1975 Lavrard ..... 335/285
4,041,549 A 8/1977 Atkinson
5,002,270 A 3/1991 Shine
5,361,412 A 11/1994 Perry
5,617,582 A * 4/1997 Burwell ..... 2/102
6,405,378 B1 * 6/2002 Garner ..... 2/102
2004/0031083 A1 2/2004 Copp

* cited by examiner

*Primary Examiner*—Tejash Patel
(74) *Attorney, Agent, or Firm*—Sturm & Fix LLP

(57) ABSTRACT

An improved vest construction (10) including an upper torso encircling garment (20) provided with at least one upper torso encircling raceway member (30) in the form of an elongated flexible track element (31) having opposed ends that are adapted to be secured to one another, as well as, a generally C-shaped cross-sectional configuration that is adapted to slidably receive a portion of a movable storage unit (13) that includes a plurality of storage receptacles (40) each provided with a wheel (44) that rolls within said flexible track element (31).

19 Claims, 2 Drawing Sheets

Fig. 5
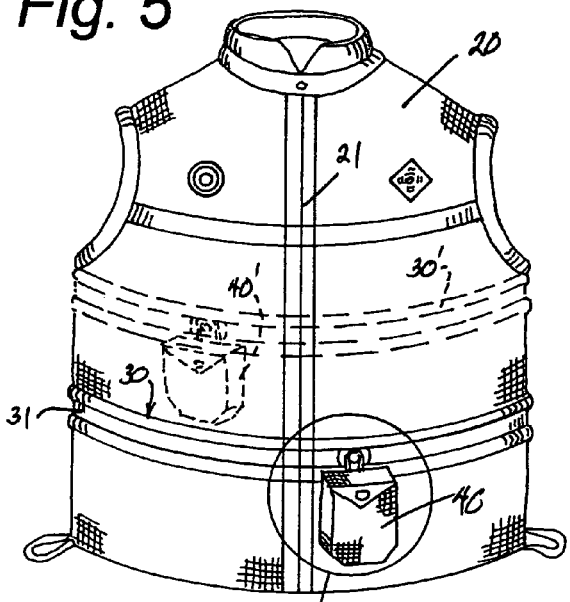
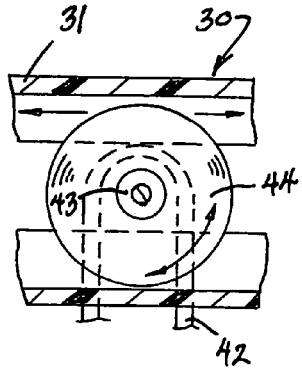
Fig. 8
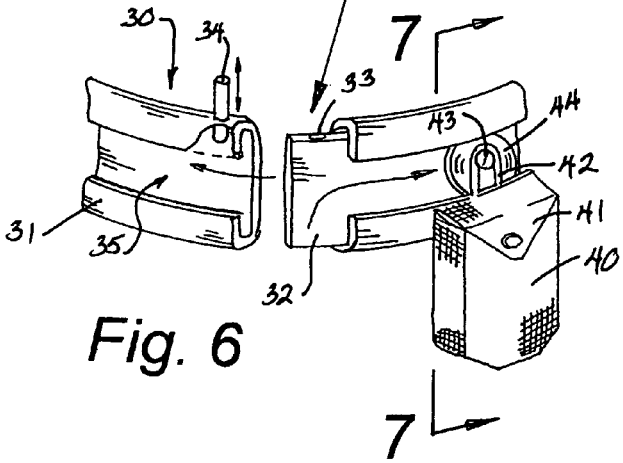
Fig. 6
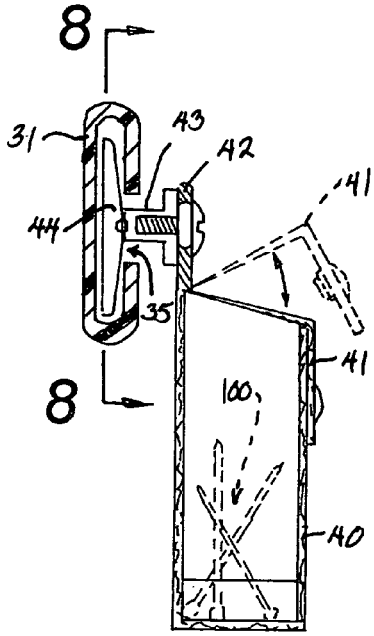
Fig. 7

WORKMAN'S VEST CONSTRUCTION

CROSS REFERENCE TO RELATED APPLICATIONS

This invention was the subject matter of Document Disclosure Program Registration Number 544,871, that was filed in the U.S. Patent and Trademark Office on Jan. 12, 2004.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of specialized vest constructions in general and in particular to an improved vest construction for construction workers and the like.

2. Description of Related Art

As can be seen by reference to the following U.S. Pat. Nos. 5,002,270; 5,361,412; 4,041,549, and patent publication number U.S. 2004/31083 A1, the prior art is replete with myriad and diverse specialized vest constructions.

While all of the aforementioned prior art constructions are more than adequate for the basic purpose and function for which they have been specifically designed, they are uniformly deficient with respect to their failure to provide a simple, efficient, and practical workman's vest construction that provides virtually instant access to a plurality of accessory compartments containing the basic items required to perform a specific task.

As most workmen are all too well aware, many work projects require that the workman carry a large number of different tools, accessories, fasteners and the like required to complete the job and the task of carrying, segregating and accessing these items oftentimes creates insurmountable obstacles.

As a consequence of the foregoing situation, there has existed a longstanding need among workmen and the like, for a new and improved vest construction provided with a plurality of compartments movably mounted on a vest wherein, each of the compartments can be brought into a desired location on the vest for access by the workman, and the provision of such a construction is a stated objective of the present invention.

BRIEF SUMMARY OF THE INVENTION

Briefly stated, the vest construction that forms the basis of the present invention comprises in general a vest unit, a raceway unit, and a movable storage unit that cooperate with one another in a unique and interrelated manner to provide simple and rapid access by the workman to a desired article contained within the movable storage unit.

As will be explained in greater detail further on in the specification, the vest unit comprises a chest encircling article of clothing that, while generally referred to as a vest, could also be a shirt, jacket or other upper torso encircling garment in keeping with the teachings of this invention wherein, the garment is further provided with a central vertical closure such as a zipper, velcro fastener, or the like.

In addition, the raceway unit includes one or more upper torso encircling raceway members that are formed as an integral part of the garment and interrupted only by the vertical closure of the garment.

Furthermore, the movable storage unit comprises a plurality of storage compartments that are suspended from wheel assemblies or the like, which are slidably received within a torso encircling raceway member so that the storage compartments can move in an upper torso encircling fashion to provide ready access into a selected compartment by the wearer of the garment.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 5 is an isolated front plan view of the vest construction;

FIG. 6 is a detail view of the raceway coupling arrangement; and

FIG. 7 is a cross-sectional view taken through line 7—7 of FIG. 6; and, FIG. 8 is a cross-sectional view taken through line 8—8 of FIG. 7.

DETAILED DESCRIPTION OF THE INVENTION

Figure 1:
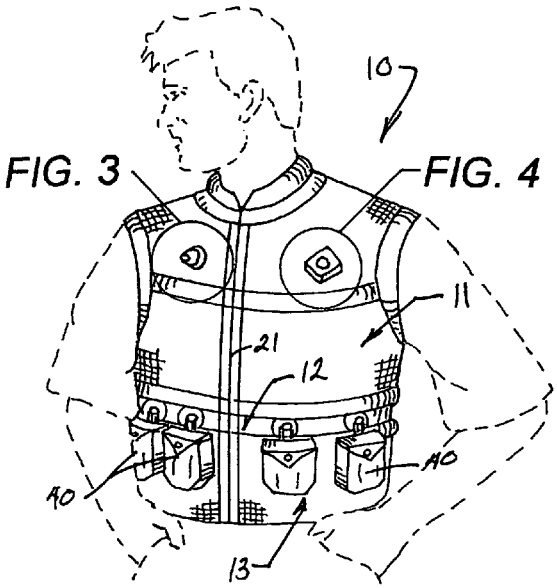
FIG. 1 is a front perspective view of the vest construction that forms the basis of the present invention.

As can be seen by reference to the drawings, and in particularly to FIG. 1, the vest construction that forms the basis of the present invention is designated generally by the reference number 10. The vest construction 10 comprises in general a vest unit 11, a raceway unit 12 and a movable storage unit 13. These units will now be described in seriatim fashion.

Figure 2:
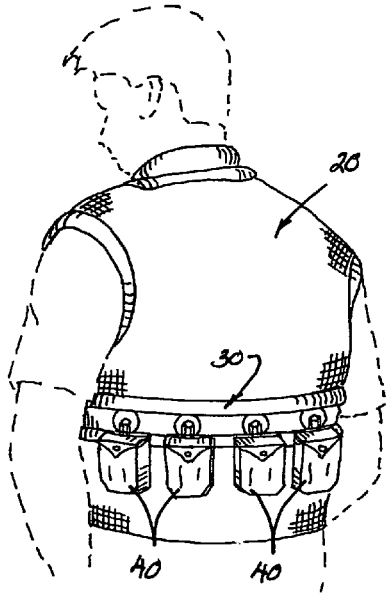
FIG. 2 is a rear perspective view of the vest construction.

As shown in FIGS. 1,2, and 5, the vest unit 11 comprises an upper torso encircling garment 20 such as a vest, shirt, jacket or the like having a central vertical closure element 21 such as a zipper, hook and loop fasteners or the like.

As can also be seen by reference to FIGS. 1,2, and 5, the raceway unit 12 comprises at least one upper torso encircling raceway member 30 in the form of a length of flexible track element 31 that is fixedly secured to the upper torso encircling garment 20 in a horizontal orientation.

Turning now to FIGS. 5 through 8, it can be seen that the length of flexible track element 31 has a generally C-shaped cross-sectional configuration wherein, the opposite ends of the flexible track element 31 are disposed adjacent to the opposed portions of the vertical closure element 21 of the upper torso encircling garment 20.

Furthermore, as depicted in FIG. 6, the opposite ends of the flexible track element 31 are adapted to be releasably engaged relative to one another such that the raceway member 30 will completely encircle the upper torso of a person wearing the garment 20.

In the embodiment depicted in FIG. 6, one end of the flexible track element is provided with an extension tab 32 having an aperture 33 and the other end of the flexible track element 31 is provided with a post element 34 mounted for reciprocatory movement into and out of engagement with the aperture 33 in the tab element 32 to fasten the ends of the track element 31 together in a well recognized fashion.

As shown in FIGS. 1 and 2, the movable storage unit 13 comprises a plurality of storage receptacles 40 each having a portion that is slidably received within the flexible track element 31 as will be explained presently.

Turning now to FIGS. 5 through 8, it can be seen that each storage receptacle 40 is provided with a hinged closure 41 and an upwardly projecting suspension element 42 attached to a rigid axle element 43 extending outwardly from a wheel 44 such that the axle element 43 projects through the central opening 35 in the track element 31 as the wheel 44 travels around the user's upper torso.

In this manner, the user moves the storage receptacles in an encircling fashion around their body to gain access to the contents of all of the storage receptacles as needed to perform a given task.

It should also be noted by reference to FIG. 5, that this invention also contemplates the provision of multiple raceway members 30 30' wherein, each raceway member 30 30' is provided with its own plurality of storage receptacles 40 40'.

Figure 3:
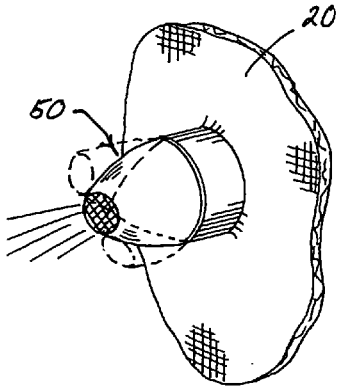
FIG. 3 is an enlarged detail view of an adjustable light contemplated for use with the vest construction.
Figure 4:
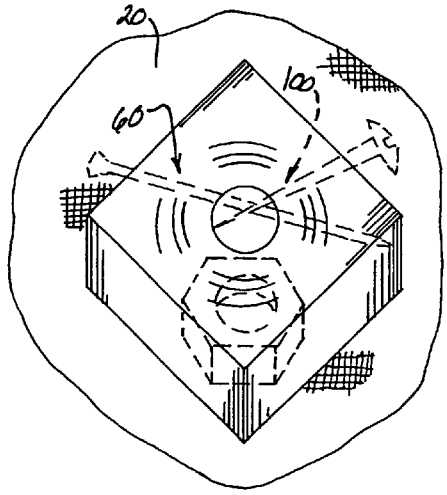
FIG. 4 is an enlarged detail view of a magnetic retention element contemplated for use with the vest construction.

Furthermore, as shown in FIGS. 2 and 3, this invention envisions the addition of an adjustable light member 50 positioned on the front of the garment member 20, as well as, a magnetic plate member 60 to captively store diverse discrete metallic articles 100 pending their utilization for a particular task.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

The invention claimed is:

1. An improved workman's vest construction comprising
- a vest unit including an upper torso encircling garment
- a raceway unit including at least one raceway member disposed in a horizontal fashion on said garment; and,
- a movable storage unit including a plurality of storage receptacles operatively and slidably associated with said at least one raceway member.

2. The vest construction as in claim 1; wherein, said at least one raceway member is disposed on said garment in an upper torso encircling fashion.

3. The vest construction as in claim 2; wherein, said at least one raceway member comprises an elongated track element.

4. The vest construction as in claim 3; wherein, said elongated track element is flexible and has a generally C-shaped cross-sectional configuration.

5. The vest construction as in claim 3; wherein, the track element has opposed ends that are adapted to be secured to one another.

6. The vest construction as in claim 4; wherein, the track element has opposed ends that are adapted to be secured to one another.

7. The vest construction as in claim 1; wherein, each of said storage receptacles is provided with a wheel that is dimensioned to be rotatably received in said at least one raceway member.

8. The vest construction as in claim 3; wherein, each of said storage receptacles is provided with a wheel that is dimensioned to be rotatably received in said elongated track element.

9. The vest construction as in claim 3; wherein, said elongated track element is flexible and has a generally C-shaped cross-sectional configuration.

10. The vest construction as in claim 3; wherein, the track element has opposed ends that are adapted to be secured to one another.

11. The vest construction as in claim 4; wherein, the track element has opposed ends that are adapted to be secured to one another.

12. The vest construction as in claim 1; wherein, said garment is further provided with a light member disposed, openly, on a front of the vest unit and providing hands-off lighting for a vest unit wearer.

13. The vest construction as in claim 1; wherein, said garment is further provided with a magnetic plate member.

14. The vest construction as in claim 13; wherein, said garment is further provided with a light member disposed, openly, on a front of the vest unit and providing hands-off lighting for a vest unit wearer.

15. The vest construction as in claim 1, wherein, said garment is further provided with a magnetic plate member having a broad face, at least one linear dimension of the broad face being greater than a distance the magnetic plate member extends outwardly from the vest unit.

16. The vest construction as in claim 1; wherein, said garment is further provided with a magnetic plate member disposed to a chest region of a wearer of the vest unit.

17. The vest construction as in claim 1; wherein, said garment is further provided with a plurality of magnetic plate members consisting of no more than ten magnetic plate members.

18. The vest construction as in claim 3; wherein, said elongated track element is flexible and comprises:
- a lower surface to which wheels of receptacles are engaged; and
- a flange, substantially parallel to the vest unit, attached to the lower surface, and disposed to the lower surface opposite the vest unit, said flange provided to keep the wheels engaged to the lower surface.

19. The vest construction as in claim 1, wherein the vest construction comprises an upper portion worn in a vicinity of a wearers shoulders, and a lower portion opposite the upper portion, and wherein the raceway unit, including at least one raceway member, is disposed substantially parallel to a horizontal plane when the vest unit is worn by a standing wearer.

* * * * *